US010794594B2

(12) United States Patent
Omokhodion

(10) Patent No.: US 10,794,594 B2
(45) Date of Patent: Oct. 6, 2020

(54) LIGHTER CASE

(71) Applicant: Omokhuale Omokhodion, Smyma, GA (US)

(72) Inventor: Omokhuale Omokhodion, Smyma, GA (US)

( * ) Notice: Subject to any disclaimer, the term of this patent is extended or adjusted under 35 U.S.C. 154(b) by 212 days.

(21) Appl. No.: 16/012,187

(22) Filed: Jun. 19, 2018

(65) Prior Publication Data

US 2019/0383487 A1 Dec. 19, 2019

(51) Int. Cl.
*F23Q 2/36* (2006.01)

(52) U.S. Cl.
CPC ..... *F23Q 2/36* (2013.01); *A45F 2200/05* (2013.01)

(58) Field of Classification Search
CPC ..... F23Q 2/36; F23Q 2/50; A45F 2200/05
See application file for complete search history.

(56) References Cited

U.S. PATENT DOCUMENTS

| | | | | |
|---|---|---|---|---|
| 4,330,954 | A | 5/1982 | Lonsmin | |
| 4,475,297 | A | 10/1984 | Lonsmin | |
| 4,486,169 | A | 12/1984 | Lewis | |
| 4,625,861 | A | 12/1986 | Krog | |
| 4,799,877 | A | 1/1989 | Bisbee | |
| D413,003 | S * | 8/1999 | Mehdikhazaneh | D27/161 |
| D441,495 | S | 5/2001 | Lin | |
| D459,541 | S | 6/2002 | Richmond | |
| D558,391 | S | 12/2007 | Lin | |
| 2008/0118400 | A1 * | 5/2008 | Neel | G01N 33/48757 422/68.1 |

* cited by examiner

*Primary Examiner* — Alfred Basichas

(57) ABSTRACT

A lighter case for covering a lighter to resemble a shotgun shell includes a disc, a first tube, and a lid. The first tube is coupled to and extends perpendicularly from the disc. The first tube has a top that is open so that the first tube is configured to insert a lighter through the top. The lid is hingedly coupled to the first tube proximate to the top. The lid is configured to selectively couple to the first tube to close the top.

8 Claims, 4 Drawing Sheets

LIGHTER CASE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cases and more particularly pertains to a new case for covering a lighter to resemble a shotgun shell.

BRIEF SUMMARY OF THE INVENTION

An embodiment of the disclosure meets the needs presented above by generally comprising a disc, a first tube, and a lid. The first tube is coupled to and extends perpendicularly from the disc. The first tube has a top that is open so that the first tube is configured to insert a lighter through the top. The lid is hingedly coupled to the first tube proximate to the top. The lid is configured to selectively couple to the first tube to close the top.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
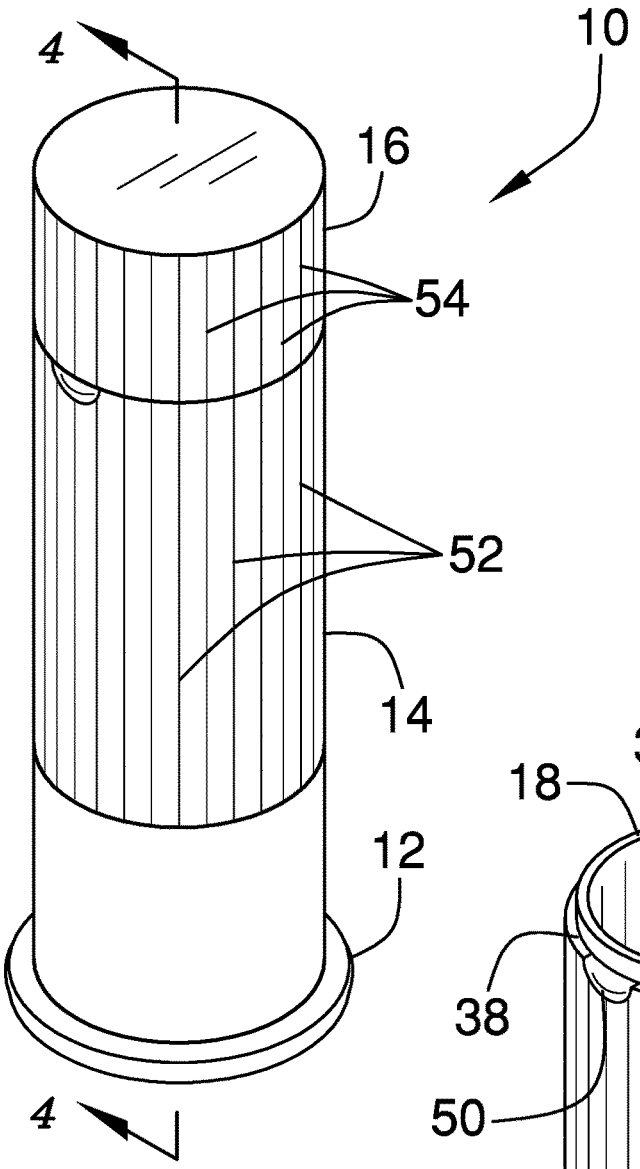
FIG. 1 is an isometric perspective view of a lighter case according to an embodiment of the disclosure.

With reference now to the drawings, and in particular to FIGS. 1 through 5 thereof, a new case embodying the principles and concepts of an embodiment of the disclosure and generally designated by the reference numeral 10 will be described.

As best illustrated in FIGS. 1 through 5, the lighter case 10 generally comprises a disc 12, a first tube 14, and a lid 16. The disc 12 comprises metal.

Figure 2:
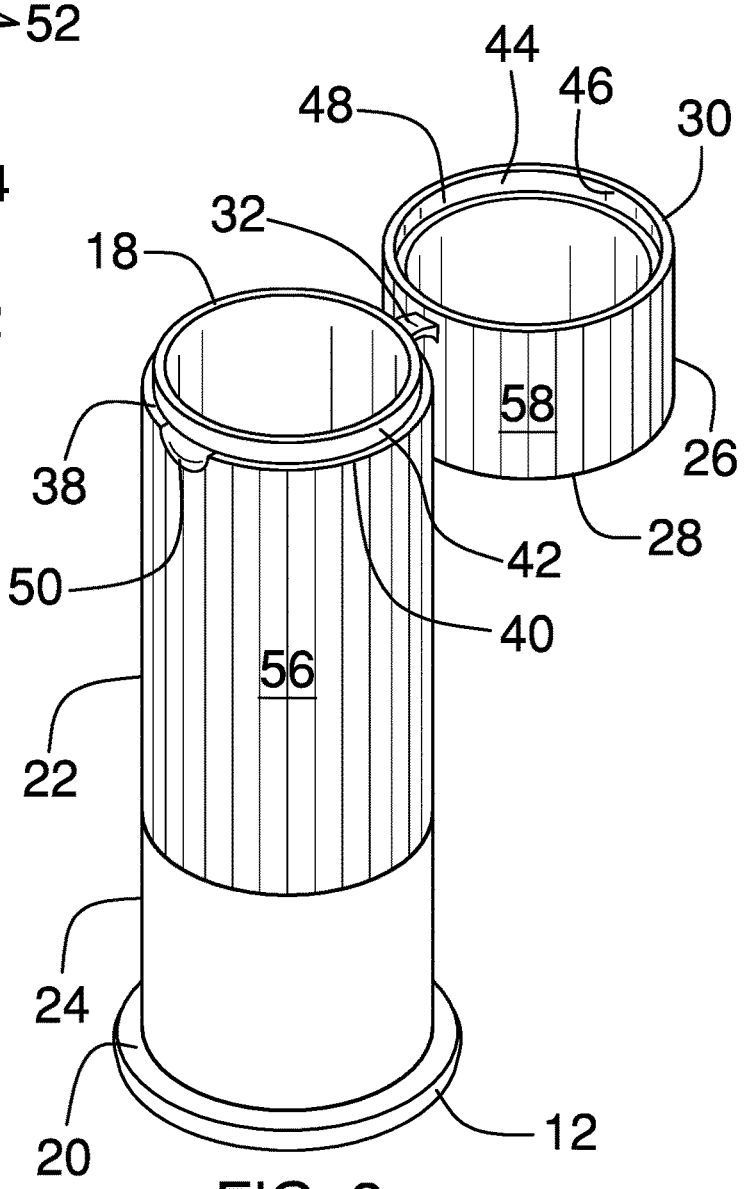
FIG. 2 is an isometric perspective view of an embodiment of the disclosure.
Figure 3:
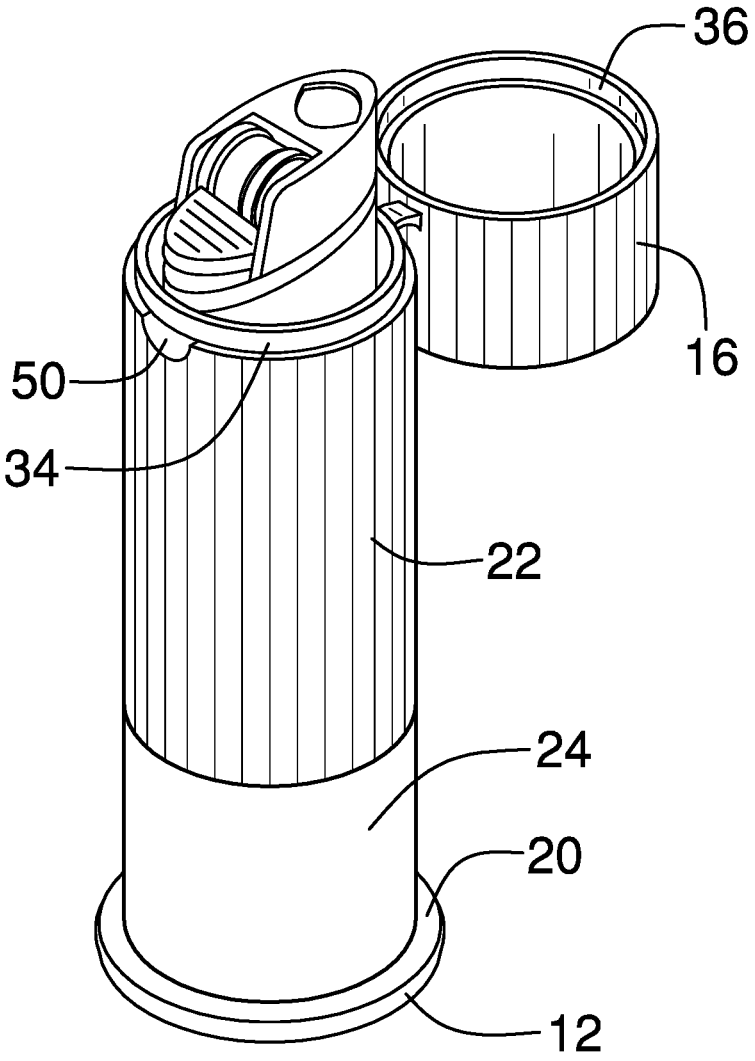
FIG. 3 is an in-use view of an embodiment of the disclosure.
Figure 5:
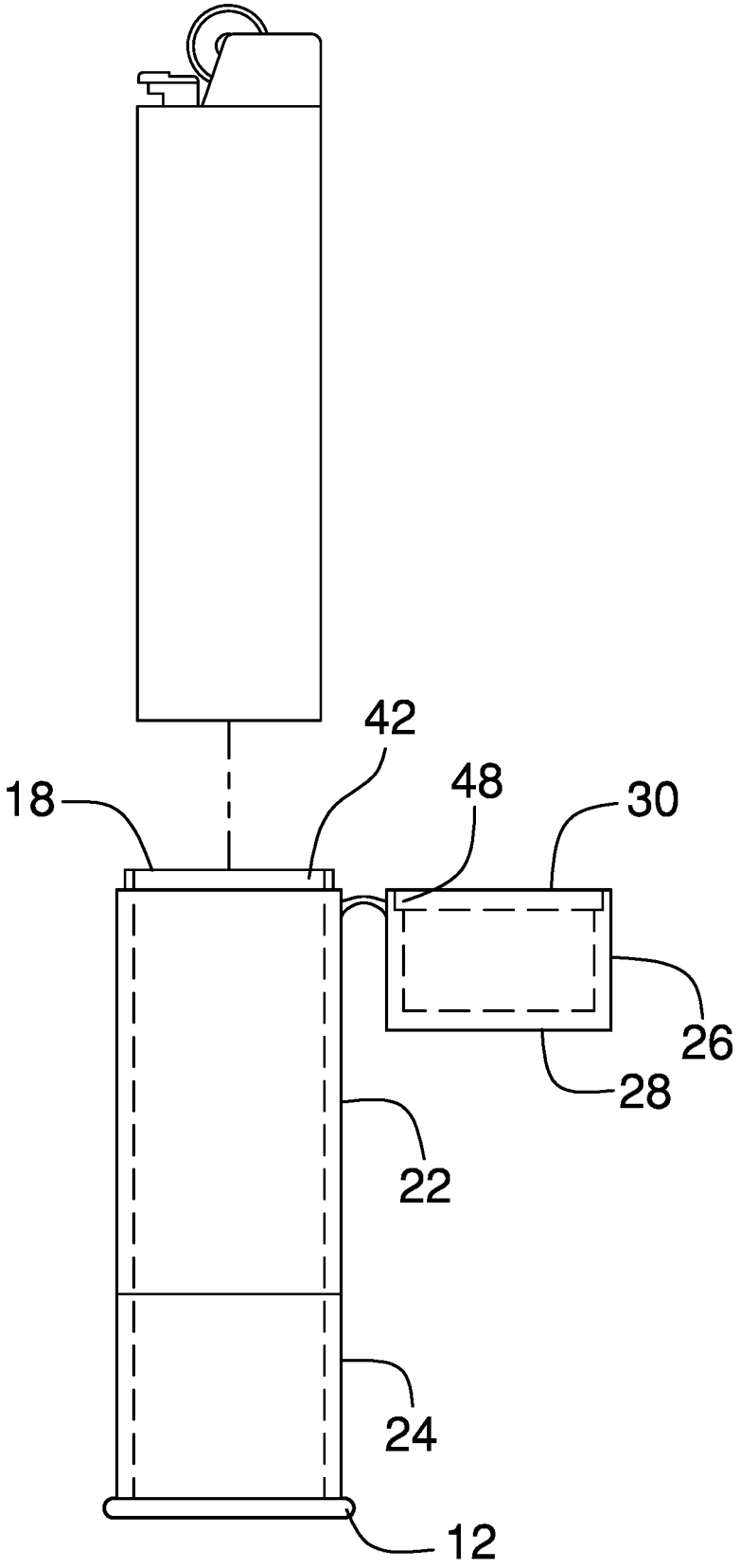
FIG. 5 is a side view of an embodiment of the disclosure.

The first tube 14 is coupled to and extends perpendicularly from the disc 12. The first tube 14 has a top 18 that is open so that the first tube 14 is configured to insert a lighter through the top 18, as shown in FIG. 5. The first tube 14 is sized so that an igniter of the lighter protrudes from the first tube 14. The first tube 14 is circumferentially smaller than the disc 12 to define a lip 20, as shown in FIG. 2. The disc 12 and the first tube 14 together resemble a shot gun shell. The first tube 14 comprises an upper section 22 and a lower section 24, as shown in FIG. 3. The lower section 24 comprises metal. The upper section 22 comprises plastic.

The lid 16 is hingedly coupled to the first tube 14 proximate to the top 18. The lid 16 is configured to selectively couple to the first tube 14 so that the lid 16 is positioned to selectively close the top 18. The lid 16 comprises plastic.

The lid 16 comprises a second tube 26 that has an upper end 28 and a lower end 30. The upper end 28 is closed. The lower end 30 is open. The lower end 30 is configured to selectively couple to the first tube 14.

A strap 32 is coupled to and extends between the second tube 26 and the first tube 14, as shown in FIG. 5. The strap 32 is flexible so that the second tube 26 is hingedly coupled to the first tube 14. The strap 32 is positioned proximate to the lower end 30 of the second tube 26 and the top 18 of the first tube 14. The second tube 26 is positioned to be pivoted relative to the first tube 14 to position the second tube 26 over the igniter of the lighter that is positioned in the first tube 14.

A first coupler 34 is coupled to the first tube 14 proximate to the top 18. A second coupler 36 is coupled to the second tube 26 proximate to the lower end 30. The second coupler 36 is complementary to the first coupler 34. The second coupler 36 is positioned to selectively couple to the first coupler 34 to couple the second tube 26 to the first tube 14 to close the top 18.

The first coupler 34 comprises a first recess 38 that extends into an outer perimeter 40 of the first tube 14 adjacent to the top 18 to defines a tenon 42, as shown in FIG. 2. The second coupler 36 comprises a second recess 44 that extends into an inner perimeter 46 of the second tube 26 adjacent to the lower end 30 to defines a mortice 48. The mortice 48 is positioned to insert the tenon 42 to frictionally couple the second tube 26 to the first tube 14.

Figure 4:
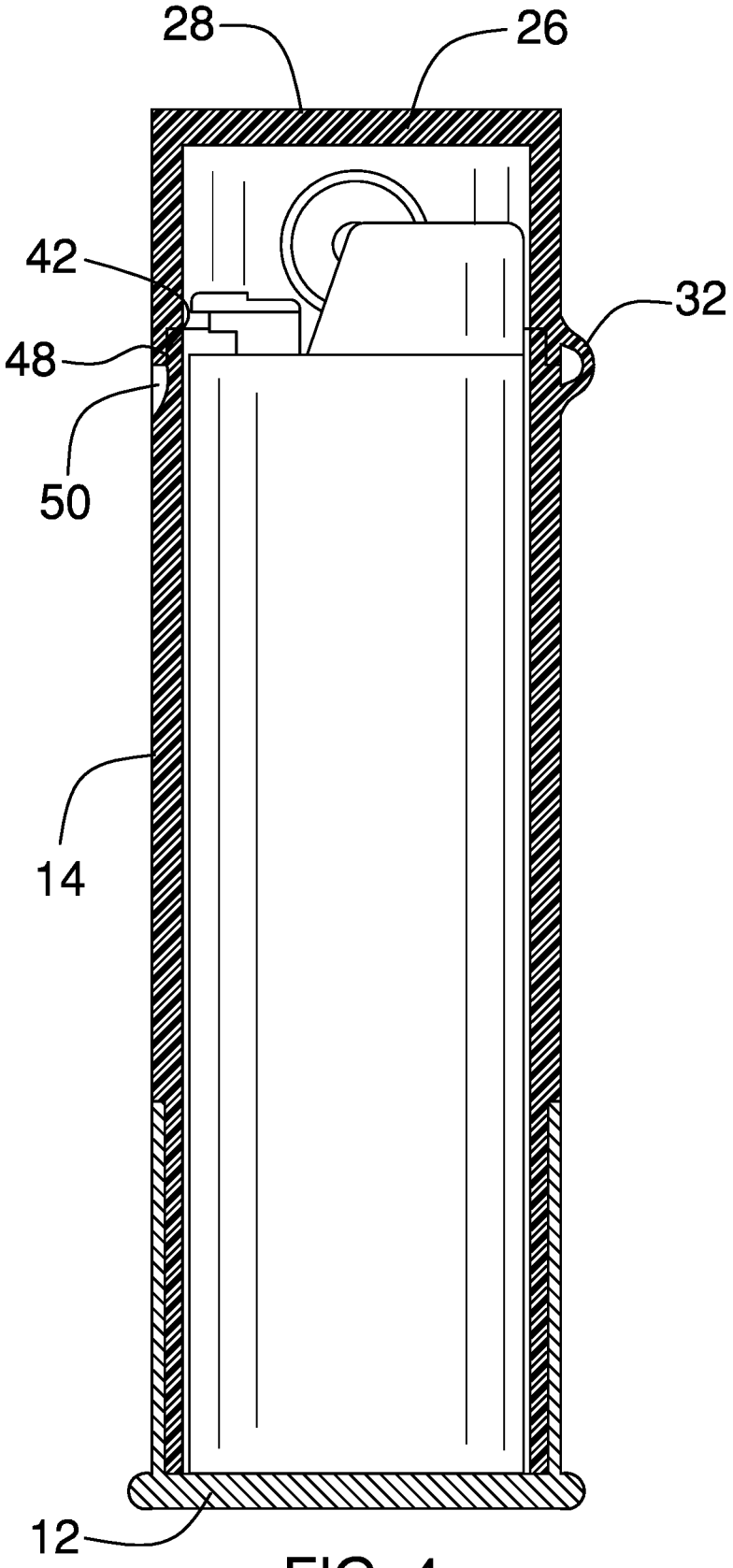
FIG. 4 is a cross-sectional view of an embodiment of the disclosure.

A third recess 50 extends arcuately from the first recess toward the disc 12, as shown in FIG. 4. The third recess 50 is opposingly positioned in the first tube 14 relative to the strap 32. The third recess 50 is configured to insert a pry tool, such as a fingernail, to pry the tenon 42 from the mortice 48. The second tube 26 is positioned to be pivoted relative to the first tube 14 to open the top 18 of the first tube 14, exposing the igniter of the lighter.

A plurality of first indentations 52 is positioned in an outer surface 56 of the upper section 22 of the first tube 14. Each first indentation 52 extends from the top 18 of the first tube 14 to the lower section 24 of the first tube 14. A plurality of second indentations 54 is positioned in an outer face 58 of the second tube 26. Each second indentation 54 extends from the upper end 28 to the lower end 30 of the second tube 26. The second indentation 54 is substantially aligned with an associated first indentation 52 when the second tube 26 is coupled to the first tube 14. The first indentations 52 and the second indentations 54 provide a texture mimicking that of the shotgun shell.

In use, the lighter is inserted through the top 18 into the first tube 14, positioning the igniter to light the lighter. The second tube 26 is positioned to be pivoted relative to the first tube 14 to position the second tube 26 over the igniter of the lighter. The mortice 48 is positioned to insert the tenon 42 to frictionally couple the second tube 26 to the first tube 14. The third recess 50 is configured to insert the pry tool to pry the tenon 42 from the mortice 48. The second tube 26 is positioned to be pivoted relative to the first tube 14 to open the top 18 of the first tube 14, again exposing the igniter of the lighter.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lighter case comprising:

a disc;

a first tube coupled to and extending perpendicularly from said disc, said first tube having a top, said top being open wherein said first tube is configured for inserting a lighter through said top, said first tube being sized such that an igniter of the lighter inserted into said first tube protrudes from said first tube; and a lid is hingedly coupled to said first tube proximate to said top, said lid being configured for selectively coupling to said first tube such that said lid is positioned for selectively closing said top, said lid comprising:

a second tube having an upper end and a lower end, said upper end being closed, said lower end being open, said lower end being configured for selectively coupling to said first tube, and a strap coupled to and extending between said second tube and said first tube, said strap being flexible such that said second tube is hingedly coupled to said first tube, said strap being positioned proximate to said lower end of said second tube and said top of said first tube wherein said second tube is positioned for pivoting relative to said first tube for positioning said second tube over the igniter of the lighter positioned in said first tube;

a first coupler coupled to said first tube proximate to said top, said first coupler comprising a first recess extending into an outer perimeter of said first tube adjacent to said top defining a tenon;

a second coupler coupled to said second tube proximate to said lower end, said second coupler being complementary to said first coupler wherein said second coupler is positioned for selectively coupling to said first coupler for coupling said second tube to said first tube for closing said top, said second coupler comprising a second recess extending into an inner perimeter of said second tube adjacent to said lower end defining a mortice wherein said mortice is positioned for inserting said tenon for frictionally coupling said second tube to said first tube;

a third recess extending arcuately from said first recess toward said disc, said third recess being opposingly positioned in said first tube relative to said strap wherein said third recess is configured for inserting a pry tool for prying said tenon from said mortice positioning said second tube for pivoting relative to said first tube for opening said top of said first tube.

2. The case of claim 1, further including said disc comprising metal.

3. The case of claim 1, further including said first tube being circumferentially smaller than said disc defining a lip such that said disc and said first tube resemble a shot gun shell.

4. The case of claim 3, further including said first tube comprising an upper section and a lower section, said lower section comprising metal.

5. The case of claim 4, further including said upper section comprising plastic.

6. The case of claim 5, further including said lid comprising plastic.

7. The case of claim 1, further comprising:

a plurality of first indentations positioned in an outer surface of said upper section of said first tube, each said first indentation extending from said top of said first tube to said lower section of said first tube; and a plurality of second indentations positioned in an outer face of said second tube, each said indentation extending from said upper end to said lower end of said second tube such that said second indentation is substantially aligned with an associated said first indentation when said second tube is coupled to said first tube.

8. A lighter case comprising:

a disc, said disc comprising metal;

a first tube coupled to and extending perpendicularly from said disc, said first tube having a top, said top being open wherein said first tube is configured for inserting a lighter through said top, said first tube being sized such that an igniter of the lighter inserted into said first tube protrudes from said first tube, said first tube being circumferentially smaller than said disc defining a lip such that said disc and said first tube resemble a shot gun shell, said first tube comprising an upper section and a lower section, said lower section comprising metal, said upper section comprising plastic;

a lid is hingedly coupled to said first tube proximate to said top, said lid being configured for selectively coupling to said first tube such that said lid is positioned for selectively closing said top, said lid comprising plastic, said lid comprising:

a second tube having an upper end and a lower end, said upper end being closed, said lower end being open, said lower end being configured for selectively coupling to said first tube, and a strap coupled to and extending between said second tube and said first tube, said strap being flexible such that said second tube is hingedly coupled to said first tube, said strap being positioned proximate to said lower end of said second tube and said top of said first tube wherein said second tube is positioned for pivoting relative to said first tube for positioning said second tube over the igniter of the lighter positioned in said first tube;

a first coupler coupled to said first tube proximate to said top;

a second coupler coupled to said second tube proximate to said lower end, said second coupler being complementary to said first coupler wherein said second coupler is positioned for selectively coupling to said first coupler for coupling said second tube to said first tube for closing said top, said first coupler comprising a first recess extending into an outer perimeter of said first tube adjacent to said top defining a tenon, said second coupler comprising a second recess extending into an inner perimeter of said second tube adjacent to said lower end defining a mortice wherein said mortice is positioned for inserting said tenon for frictionally coupling said second tube to said first tube;

a third recess extending arcuately from said first recess toward said disc, said third recess being opposingly positioned in said first tube relative to said strap wherein said third recess is configured for inserting a pry tool for prying said tenon from said mortice positioning said second tube for pivoting relative to said first tube for opening said top of said first tube;

a plurality of first indentations positioned in an outer surface of said upper section of said first tube, each said first indentation extending from said top of said first tube to said lower section of said first tube; and a plurality of second indentations positioned in an outer face of said second tube, each said indentation extending from said upper end to said lower end of said second tube such that said second indentation is substantially aligned with an associated said first indentation when said second tube is coupled to said first tube.

* * * * *